US008210003B2

(12) United States Patent
Zheng

(10) Patent No.: US 8,210,003 B2
(45) Date of Patent: Jul. 3, 2012

(54) KNITTING NEEDLE AND CROCHET HOOK ASSEMBLY

(76) Inventor: Liyun Zheng, Troy, MI (US)

( * ) Notice: Subject to any disclaimer, the term of this patent is extended or adjusted under 35 U.S.C. 154(b) by 0 days.

(21) Appl. No.: 13/294,502

(22) Filed: Nov. 11, 2011

(65) Prior Publication Data

US 2012/0118021 A1 May 17, 2012

Related U.S. Application Data

(60) Provisional application No. 61/414,022, filed on Nov. 16, 2010.

(51) Int. Cl.
*D04B 35/02* (2006.01)

(52) U.S. Cl. ..... 66/117

(58) Field of Classification Search ..... 66/116, 66/117, 118, 1 A
See application file for complete search history.

(56) References Cited

U.S. PATENT DOCUMENTS 1,960,133 A * 5/1934 Aivazian ..... 66/117
1,999,691 A * 4/1935 Ghaham ..... 66/117
2,061,282 A * 11/1936 Leboff et al. ..... 66/117
2,093,631 A * 9/1937 Burnham ..... 66/117
2,094,262 A * 9/1937 Burnham ..... 66/117
2,096,482 A * 10/1937 Cook et al. ..... 66/117
2,096,483 A * 10/1937 Cook ..... 66/117
2,102,600 A * 12/1937 Miller ..... 66/117
2,118,210 A * 5/1938 Luther ..... 66/1 A
2,128,871 A * 8/1938 Wong ..... 66/117
2,133,431 A * 10/1938 Craft ..... 66/117
2,183,791 A * 12/1939 Dunn ..... 66/117
2,208,124 A * 7/1940 Dunn ..... 66/117
2,230,495 A * 2/1941 Kohlmann ..... 66/117
2,242,880 A * 5/1941 Dunn ..... 66/117
2,462,473 A * 2/1949 Delaney ..... 66/117
2,507,174 A * 5/1950 Phillips ..... 66/118
2,633,720 A * 4/1953 Robbins ..... 66/117
2,693,095 A * 11/1954 Slingsby ..... 66/117
2,695,506 A * 11/1954 Kohlmann ..... 66/117
2,817,221 A * 12/1957 Perham ..... 66/117
3,603,115 A * 9/1971 Elzey et al. ..... 66/117
3,927,538 A * 12/1975 Martella ..... 66/117
4,007,610 A * 2/1977 Linstead ..... 66/117
4,195,496 A * 4/1980 Vasquez et al. ..... 66/117
4,341,094 A * 7/1982 Heide ..... 66/117
4,494,387 A * 1/1985 Phipps et al. ..... 66/117
4,501,133 A * 2/1985 Kretzschmar et al. ..... 66/117
4,553,410 A * 11/1985 Okada ..... 66/117
4,646,543 A * 3/1987 Okada ..... 66/117
4,680,947 A * 7/1987 Phipps et al. ..... 66/117
4,693,094 A * 9/1987 Kahn ..... 66/117
5,720,187 A * 2/1998 Matuo ..... 66/117
6,397,640 B1 * 6/2002 Williams ..... 66/117
6,668,597 B2 * 12/2003 Robinson ..... 66/118
6,983,627 B1 * 1/2006 Eley-Holden-Sotnik ..... 66/117
7,117,693 B1 * 10/2006 Nova ..... 66/117
7,954,342 B2 * 6/2011 Devagnanam ..... 66/117

* cited by examiner

*Primary Examiner* — Danny Worrell
(74) *Attorney, Agent, or Firm* — Harness, Dickey & Pierce, P.L.C.

(57) ABSTRACT

A yarn needle assembly may include a first needle member, a second needle member and a cable. The cable may have a first end coupled to an end of the first needle member and a second end coupled to an end of the second needle member. The cable may include a metal cable formed from a plurality of braided metal strands with a nylon coating surrounding the metal cable. The relationship between an overall diameter (D1) of the metal cable, a diameter (D2) of each of the individual metal strands and a total number (N) of braided metal strands may be defined by: (N)(D2)/D1<0.5.

15 Claims, 2 Drawing Sheets

KNITTING NEEDLE AND CROCHET HOOK ASSEMBLY

CROSS-REFERENCE TO RELATED APPLICATIONS

This application claims the benefit of U.S. Provisional Application No. 61/414,022, filed on Nov. 16, 2010. The entire disclosure of the above application is incorporated herein by reference.

FIELD

The present disclosure relates to knitting needles and crochet hooks.

SUMMARY

This section provides a general summary of the disclosure, and is not a comprehensive disclosure of its full scope or all of its features.

A yarn needle assembly may include a first needle member, a second needle member and a cable. The cable may have a first end coupled to an end of the first needle member and a second end coupled to an end of the second needle member. The cable may include a metal cable formed from a plurality of braided metal strands with a nylon coating surrounding the metal cable. The relationship between an overall diameter (D1) of the metal cable, a diameter (D2) of each of the individual metal strands and a total number (N) of braided metal strands may be defined by: $(N)(D2)/D1<0.5$.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 1:
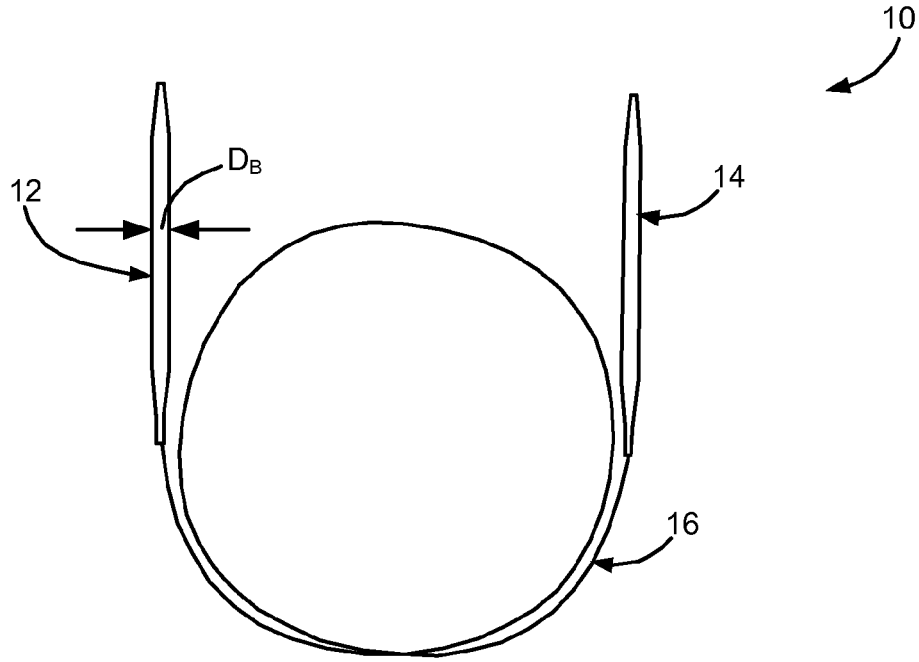
FIG. 1 is a schematic illustration of a knitting needle assembly including circular knitting needles connected by a cable according to the present disclosure.
Figure 2:
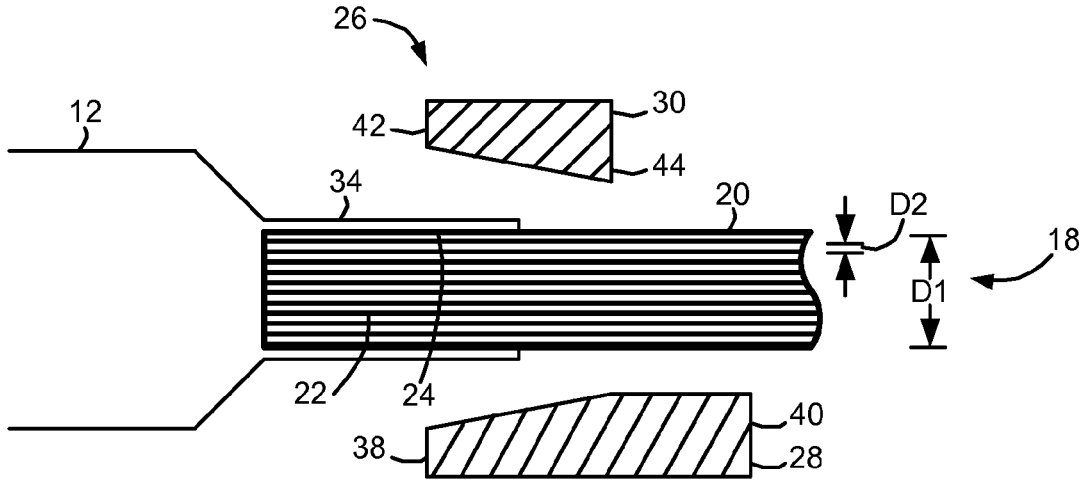
FIG. 2 is a fragmentary schematic section view the knitting needle assembly of FIG. 1 including a mold for forming the knitting needle assembly.
Figure 3:
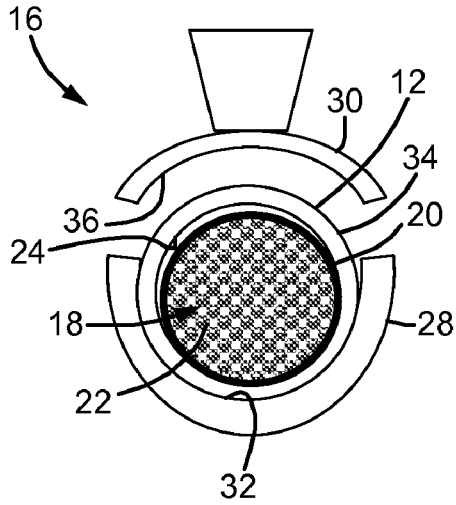
FIG. 3 is an additional fragmentary schematic section view the knitting needle assembly and mold shown in FIG. 2.
Figure 4:
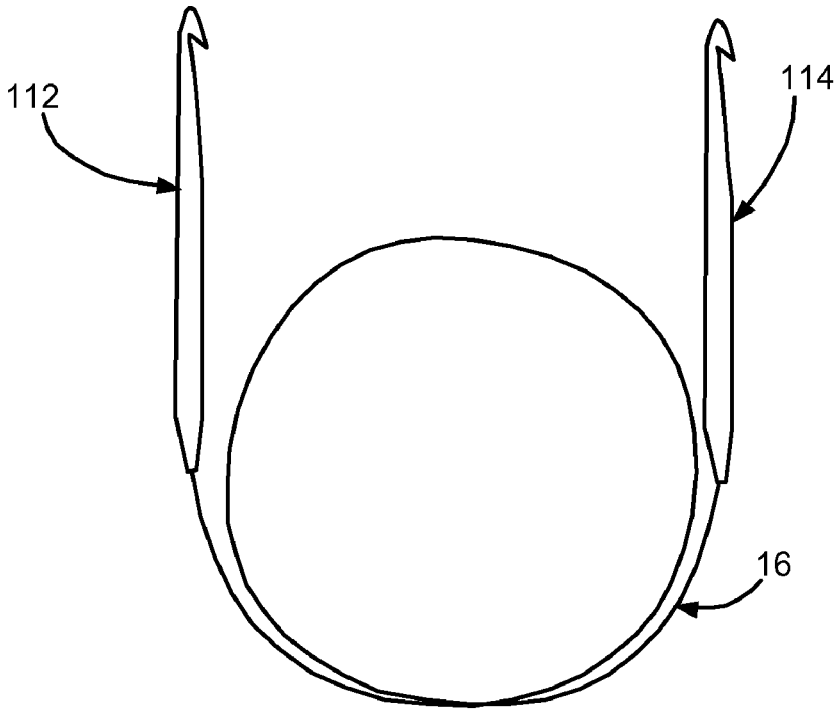
FIG. 4 is a schematic illustration of a crochet hook assembly including circular crochet hooks connected by a cable according to the present disclosure.

As seen in FIGS. 1-3, a yarn needle assembly 10 may include first and second needle members 12, 14 connected by a cable 16. The term "yarn needle assembly" is intended to include knitting needle assemblies and crochet hook assemblies and the present disclosure applies equally to knitting needles and crochet hooks. Therefore, while discussed in combination with first and second knitting needles, it is understood that the present disclosure applies equally to arrangements where the first and second needle members 12, 14 are in the form of crochet hooks 112, 114 (seen in FIG. 4).

The cable 16 may include a braided metal cable 18 and a nylon coating 20. The braided metal cable 18 may be formed from metal strands 22. The braided metal cable 18 and a nylon coating 20 may be sized to accommodate crimping and flexibility. In a first example, for a needle size less than 4.0 millimeters (mm), the braided metal cable 18 includes an overall diameter (D1) of 1.3 mm to 1.4 mm formed from forty to sixty metal strands 22, each having a diameter (D2) between 0.01 mm and 0.015 mm. The nylon coating 20 defines a wall thickness of 0.2 mm to 0.3 mm. The needle size may be defined as the diameter ($D_B$) of the needle main body.

In a second example, for a needle size greater than 4.0 millimeters (mm), the braided metal cable 18 includes an overall diameter (D1) of 1.3 mm to 2.0 mm formed from forty to eighty metal strands 22, each having a diameter (D2) between 0.01 mm and 0.015 mm. The nylon coating 20 defines a wall thickness of 0.2 mm to 0.4 mm.

In both the first and second examples, the cable 16 (including the braided metal cable 18 and the nylon coating 20) may be located in a bore 24 defined by the first needle member 12. The first needle member 12 may be crimped to fix the first needle member 12 to the cable 16. The second needle member 14 may be fixed to the cable 16 in a similar manner. Therefore, for simplicity, the engagement between the second needle member 14 and the cable 16 will not be described in detail with the understanding that the description of the first needle member 12 applies equally.

In both the first and second examples, the braided metal cable 18 may be defined by a ratio between the product of the diameter (D2) of the metal strands 22 and the number (N) of metal strands 22 and the overall diameter (D1) of the braided metal cable 18. The ratio (N*D2/D1) may be greater than 0.5, or the ratio (D1/(N*D2)) may be less than 2.

The crimping process may include use of a mold assembly 26 including a fixed portion 28 and a reciprocating portion 30. The fixed portion 28 may include a contoured inner surface 32 that generally conforms to an outer surface 34 at an end of the first needle member 12 defining the bore 24. The reciprocating portion 30 may be displaceable relative to the fixed portion 28 and may also define a contoured inner surface 36 that generally conforms to the outer surface 34 of the first needle member 12.

The contoured inner surface 32 of the fixed portion 28 and the contoured inner surface 36 of the reciprocating portion 30 may each extend at an angle relative to an axial extent of the first needle member 12. The end of the first needle member 12 defining the bore 24 may be located between axial ends 38, 40 of the fixed portion 28 and between axial ends 42, 44 of the reciprocating portion 30.

The reciprocating portion 30 may apply a crimping force multiple times during assembly. The first needle member 12 may be rotated between crimping events and displaced axially during the crimping process to provide a desired distribution of crimping force. The first needle member 12 may be rotated 45 degrees or less per crimping event and may be axially displaced a total of 2 mm to 5 mm according to needle size, to ensure strong and smooth connection.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A yarn needle assembly comprising:

a first needle member;

a second needle member; and a cable having a first end coupled to an end of the first needle member and a second end coupled to an end of the second needle member, the cable including:

a metal cable formed from a plurality of braided metal strands with the relationship between an overall diameter (D1) of the metal cable, a diameter (D2) of each of the individual metal strands and a total number (N) of braided metal strands defined by:

$(N)(D2)/D1<0.5$; and a nylon coating surrounding the metal cable.

2. The yarn needle assembly of claim 1, wherein a needle size of the first and second needle members defined by a diameter of a main body of each of the first and second needle members is less than 4.0 millimeters.

3. The yarn needle assembly of claim 2, wherein the nylon coating defines a wall thickness of at least 0.2 millimeters and no greater than 0.3 millimeters.

4. The yarn needle assembly of claim 3, wherein the overall diameter (D1) of the metal cable is at least 1.3 millimeters and no more than 1.4 millimeters.

5. The yarn needle assembly of claim 4, wherein the total number (N) of braided metal strands is at least 40 and no greater than 60.

6. The yarn needle assembly of claim 5, wherein the diameter (D2) of each of the individual braided metal strands is at least 0.01 millimeters and no greater than 0.015 millimeters.

7. The yarn needle assembly of claim 1, wherein a needle size of the first and second needle members defined by a diameter of a main body of each of the first and second needle members is at least 4.0 millimeters.

8. The yarn needle assembly of claim 7, wherein the nylon coating defines a wall thickness of at least 0.2 millimeters and no greater than 0.4 millimeters.

9. The yarn needle assembly of claim 8, wherein the overall diameter (D1) of the metal cable is at least 1.3 millimeters and no more than 2.0 millimeters.

10. The yarn needle assembly of claim 9, wherein the total number (N) of braided metal strands is at least 40 and no greater than 80.

11. The yarn needle assembly of claim 10, wherein the diameter (D2) of each of the individual braided metal strands is at least 0.01 millimeters and no greater than 0.015 millimeters.

12. The yarn needle assembly of claim 1, wherein the end of the first needle member defines a first bore and the end of the second needle member defines a second bore with the first end of the cable being secured within the first bore and the second end of the cable being secured within the second bore.

13. The yarn needle assembly of claim 12, wherein a crimped engagement secures the first end of the cable within the first bore and the second end of the cable within the second bore.

14. The yarn needle assembly of claim 1, wherein the first needle member is a first knitting needle and the second needle member is a second knitting needle.

15. The yarn needle assembly of claim 1, wherein the first needle member is a first crochet hook and the second needle member is a second crochet hook.

* * * * *